US006164413A

United States Patent [19]

Sagol

[11] Patent Number: 6,164,413

[45] Date of Patent: Dec. 26, 2000

[54] FOLDING SAWHORSE

[75] Inventor: Sami Sagol, Ramat Hasharon, Israel

[73] Assignee: Keter Plastic Ltd., Herzelia, Israel

[21] Appl. No.: 09/320,849

[22] Filed: May 26, 1999

[30] Foreign Application Priority Data

May 27, 1998 [IL] Israel ..... 124680

[51] Int. Cl.[7] ..... B27B 21/00

[52] U.S. Cl. ..... 182/153; 182/182.5; 182/182.4

[58] Field of Search ..... 182/153, 225, 182/226, 182.3, 182.4, 182.5, 181.1

[56] References Cited

U.S. PATENT DOCUMENTS

| | | | |
|---|---|---|---|
| 295,269 | 3/1884 | Miller | 182/153 |
| 869,461 | 10/1907 | Rosenbaum | 182/153 |
| 2,257,876 | 10/1941 | Berchem | 182/153 |
| 2,324,196 | 7/1943 | Gozier | 182/182.5 |
| 2,583,244 | 1/1952 | Underwood | 248/166 |
| 3,734,235 | 5/1973 | Lanier | 182/153 |
| 4,121,814 | 10/1978 | Prior . | |
| 4,782,917 | 11/1988 | Schulz | 182/225 |
| 5,305,851 | 4/1994 | Katson | 182/204 |
| 5,560,448 | 10/1996 | Yemini | 182/225 |

*Primary Examiner*—Alvin Chin-Shue
*Attorney, Agent, or Firm*—Eitan, Pearl, Latzer & Cohen-Zedek

[57] ABSTRACT

A sawhorse for supporting workpieces while being worked is provided. The sawhorse includes a pair of sides which are joined at their upper ends for supporting the workpiece and which diverge at their lower ends for stable support of the sawhorse and the workpiece thereon on a horizontal supporting surface, characterized in that the lower end of each of the sides includes vertically-adjustable extension for adjusting the height of the sawhorse.

6 Claims, 4 Drawing Sheets

FOLDING SAWHORSE

FIELD OF THE INVENTION

The present invention relates to sawhorses, namely to a type of rack for use in holding various workpieces while they are being worked. For example, one such sawhorse may be used for holding a board, pipe, or similar member while it is being sawed; and two of such sawhorses may be used for holding a panel while it is being sawed.

BACKGROUND OF THE INVENTION

Sawhorses of this type generally are provided in fixed heights according to the average height of the person using the sawhorse. However, since people vary widely in height, a sawhorse to be used by a tall person may not be conveniently usable by a short person, and vice versa.

An object of the present invention is to provide a sawhorse having advantage in the above respect.

According to a broad aspect of the present invention, there is provided a sawhorse for supporting workpieces while being worked, the sawhorse including a pair of sides which are joined at their upper ends for supporting the workpiece and which diverge at their lower ends for stable support of the sawhorse and the workpiece thereon on a horizontal supporting surface, characterized in that the lower end of each of the sides includes vertically-adjustable extension for adjusting the height of the sawhorse.

According to further features in the described preferred embodiment of the invention, each of the sides includes a pair of legs at the lower end of the respective side, and each of the extensions is telescopingly attachable to one of the legs at a selected one of a plurality of different vertical positions. In the described embodiment, the lower end or each leg is hollow, and each of the extensions is telescopingly receivable within one of the hollow legs and is fixable thereto at a selected position therein.

According to further features in the described preferred embodiment, each of the extensions is formed with a longitudinal slot extending from the upper end of the extension but terminating short of its lower end. Each of the slots permits the upper end of the extension to be forcibly deformed towards closing the slot to facilitate the insertion of the extension into the lower end of the hollow leg, and the firm gripping of the extension within the hollow leg. The lower non-slotted end of each of the extensions is fitted with a rubber foot.

According to still further features in the described preferred embodiment, each extension is fixable to its respective leg by a pin passing through an opening in the lower end of the leg and a selected one of a plurality of openings in the extension. In the described embodiment, each of the legs includes a plurality of vertically-spaced pairs of horizontally-aligned openings; and the pin is of a U-shaped configuration including a head joining two parallel shank receivable within the pair of horizontally aligned openings in each leg and a selected pair of horizontally-aligned openings in the extension.

According to still further features in the described preferred embodiment, each of the sides of the sawhorse is made as a one-piece plastic unit. The pair of sides are pivotally mounted together at their top to an open, operative position, or to a folded, compact position for shipping or storing purposes.

As will be described more particularly below, a sawhorse constructed in accordance with the foregoing features may be conveniently adjusted to the height of the user as and when desired.

Further features and advantages of the invention will be apparent from the description below.

BRIEF DESCRIPTION OF THE DRAWINGS

The invention is herein described, by way of example only, with reference to the accompanying drawings, wherein.

DETAILED DESCRIPTION OF THE PRESENT INVENTION

Figure 1:
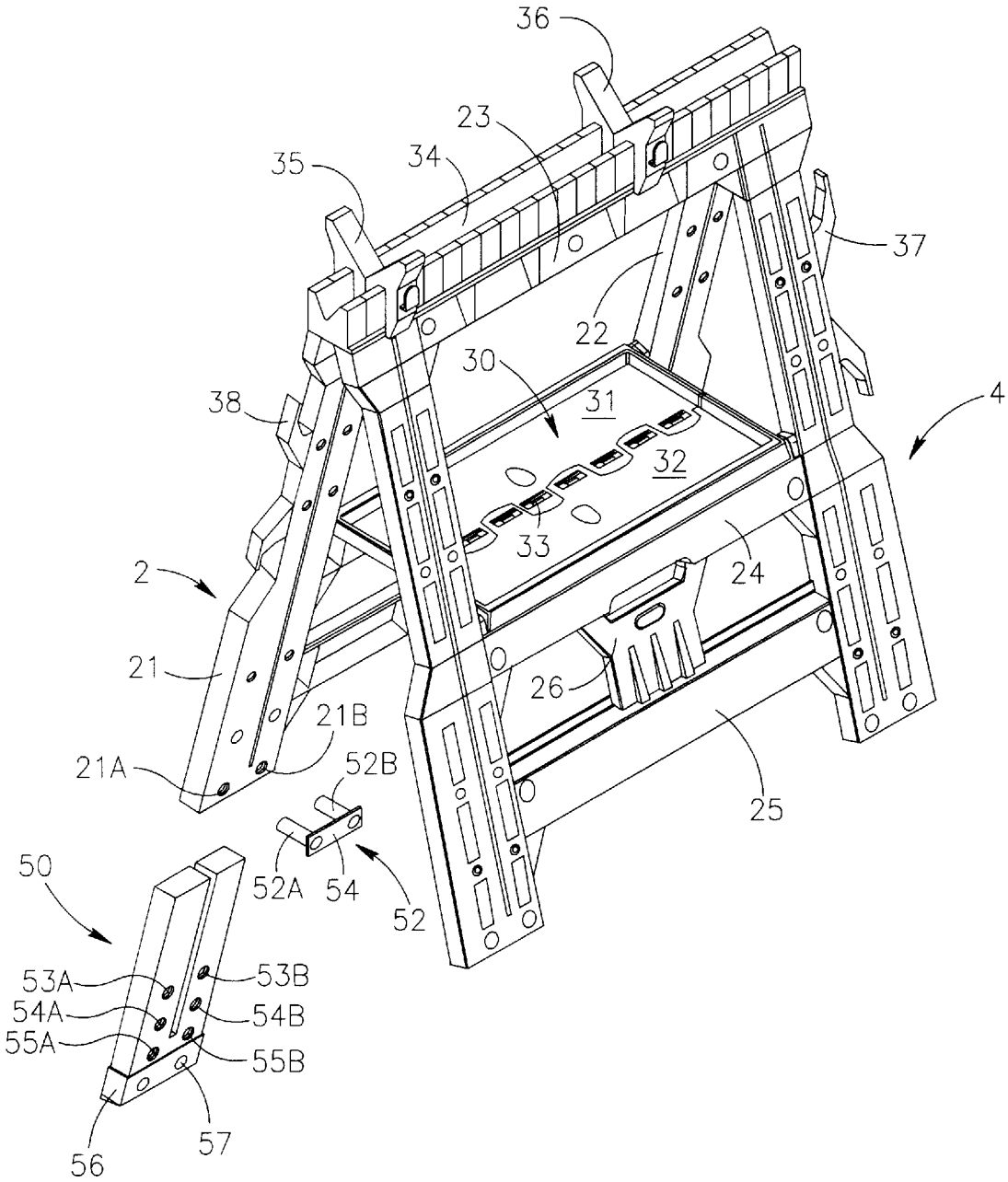
FIG. 1 is an exploded, three-dimensional, view illustrating one form of folding sawhorse constructed in accordance with the present invention.
Figure 2:
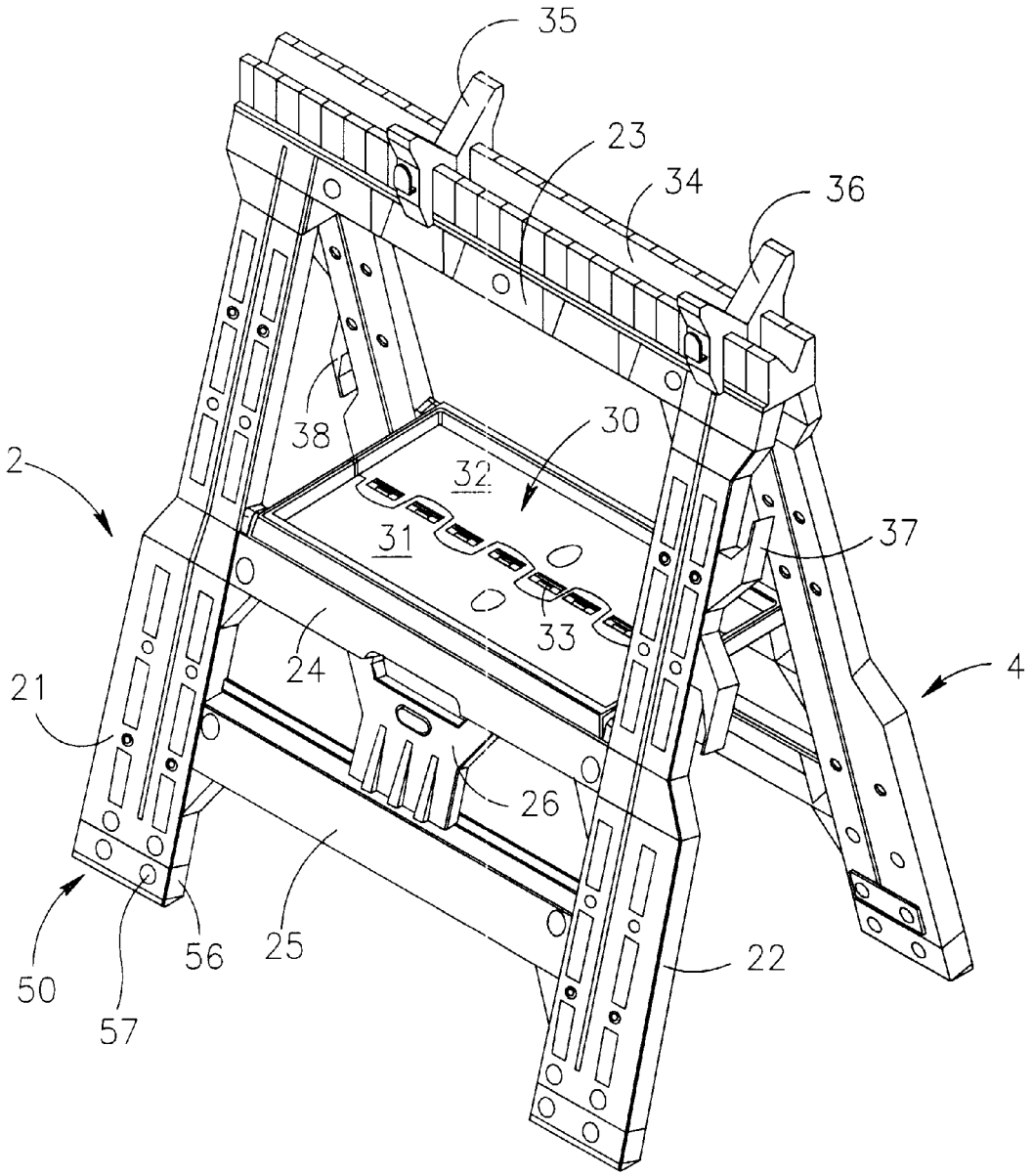
FIG. 2 illustrates the sawhorse of FIG. 1 in an open, operative position adjusted to minimum height.
Figure 3:
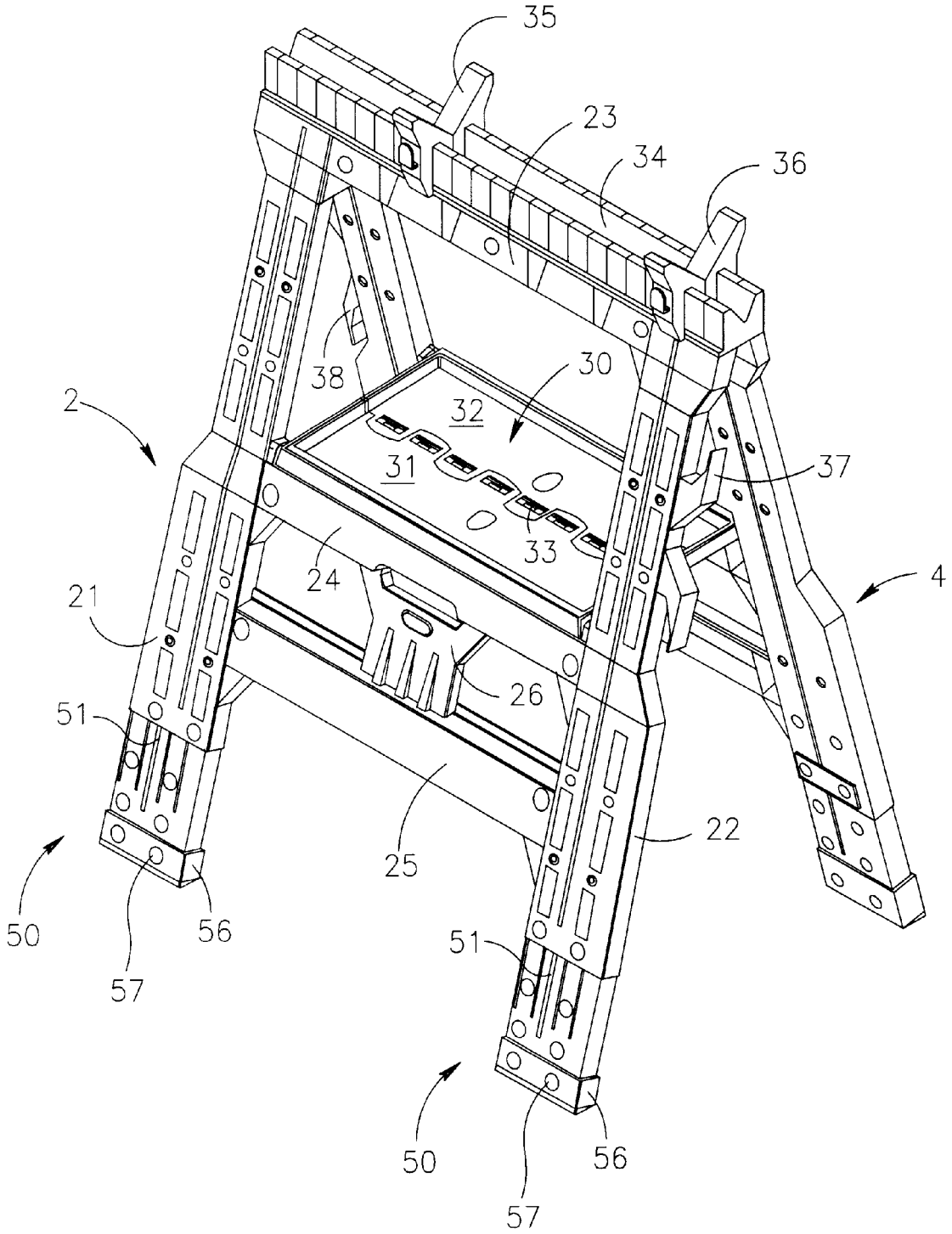
FIG. 3 is a view similar to that of FIG. 2 but showing the sawhorse adjusted to its maximum height.
Figure 4:
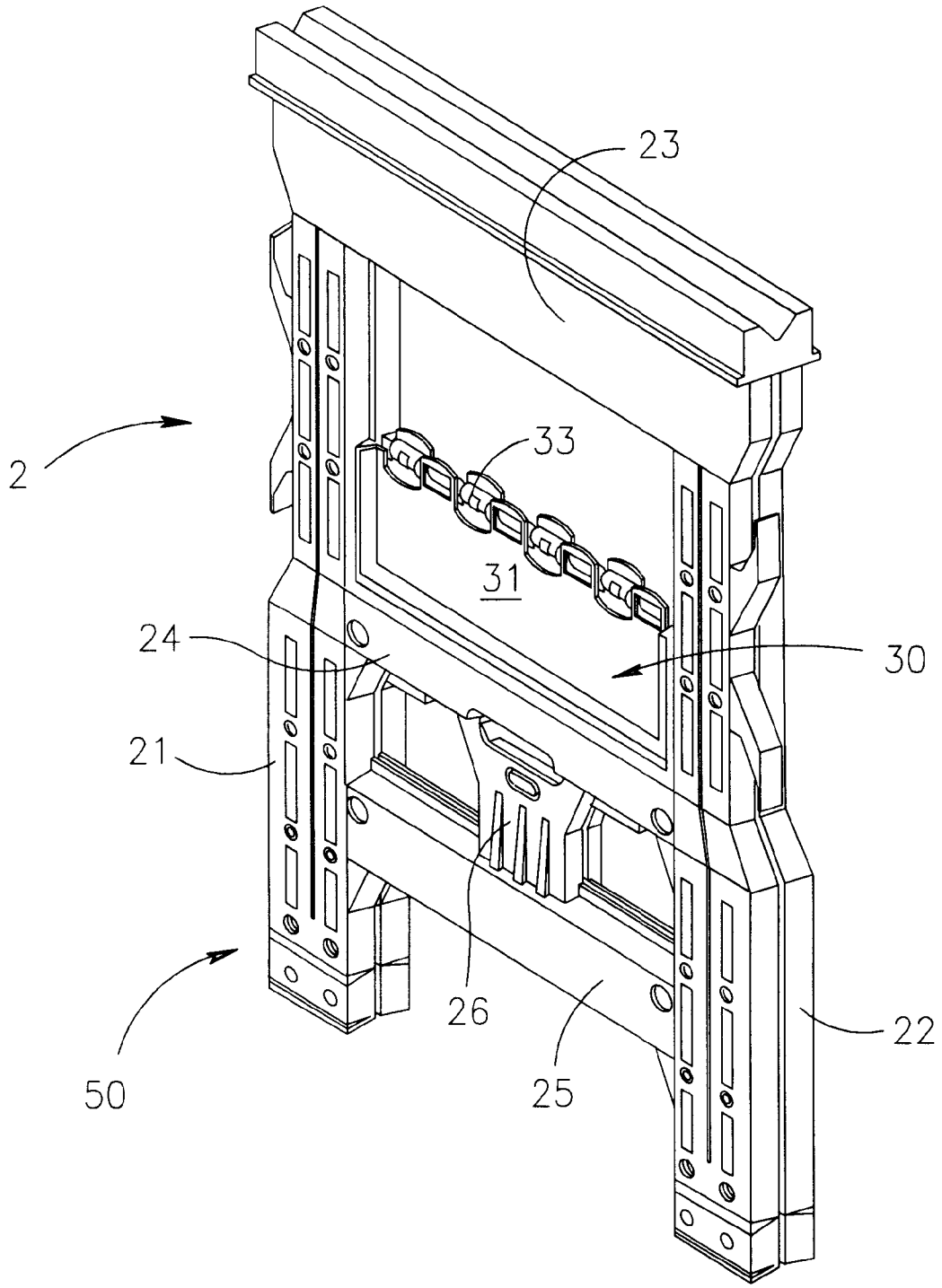
FIG. 4 illustrates the sawhorse of FIGS. 1–3 in a folded, compact condition for transportation or storage.

The sawhorse illustrated in the drawings is of the folding type, in that it includes two sides 2, 4, which are pivotally mounted by a pivot pin (not shown) at their upper ends to enable the two sides to be pivoted to an open operative position as shown in FIGS. 1–3, or to a closed compact position, as shown in FIG. 4, for transportation or storage. Each of the two sides 2, 4 is made as a one-piece plastic unit, such as by injection-molded plastic, e.g polypropylene. Both sides 2, 4 are of the same construction, and therefore the following description of side 2 will also apply with respect to side 4.

Side 2 includes a pair of legs 21, 22, joined together by a top cross-bar 23, by an intermediate cross-bar 24, and by a further cross-bar 25 slightly below cross-bar 24 but spaced from the bottom of the legs. Cross-bars 24, 25 serve to brace the two legs 21, 22. Further bracing of the side is provided by a vertically-extending reinforcing bar 26 joining the two bracing bars 24, 25 at their mid-portions.

The two sides 2, 4, also mount a table, generally designated 30, which extends between them in the open, operative position of the sawhorse. Table 30 is constructed of two sections 31, 32. Section 31 is pivotally mounted at one edge to bar 24 of side 2; and table section 32 is pivotally mounted at one edge to the corresponding bar in side 4. The two table sections 31, 32 are hinged together at their confronting edges, as shown at 33. The arrangement is such that when the sawhorse is opened to its operative position as shown in FIGS. 1–3, the two table sections 31, 32 become aligned to define a flat horizontal table for supporting workpieces and the like, and also for further bracing the open sawhorse; but when the two sides 2, 4 of the sawhorse are pivoted together, the two table sections 31, 32 also pivot about hinge 33 to permit the sawhorse to assume the folded condition illustrated in FIG. 4.

The top cross-bar 23 is formed with an upwardly-opening V-shaped recess, as shown at 34, for receiving small-diameter pipes or the like to be sawed or otherwise worked. In addition, a pair of upwardly-opening hook members 35, 36 are removably attached to the top cross-bar 23 for supporting larger-diameter pipes, boards, or the like to be worked. In addition, both sides 2, 4 of the sawhorse include outwardly-opening hooks 27 and 38 for receiving a cable when coiled thereon.

According to an important feature of the present invention, the lower end of each of the sides 2, 4 of the sawhorse includes a vertically-adjustable extension for adjusting the height of the sawhorse. The construction of such a vertical extension is best seen in FIG. 1, and is therein generally designated 50.

Thus, as shown in FIG. 1, each of the two legs of the sides 2, 4 (e.g. legs 21, 22 of side 2) is of a hollow rectangular configuration; and each of the extensions 50 is of a complementary rectangular configuration for insertion from the bottom of the hollow leg. Each extension 50 is formed with a longitudinal slot 51 extending from the upper end of the extension but terminating short of its lower end. Slot 51 permits the upper end of the extension to be forcibly deformed towards closing the slot to facilitate the insertion of the extension into the lower end of the respective hollow leg. It also provides for a firm gripping of the extension within the hollow leg when so inserted.

When an extension 50 has been telescopingly received within its respective hollow leg, it is fixed therein at a selected position according to the desired height of the sawhorse. Each extension is fixed in the selected position by a pin, generally designated 52, receivable within aligned openings in the hollow leg and in the extension.

As shown in FIG. 1, pin 52 is of a U-shaped configuration. It includes two parallel shanks 52*a*, 52*b* joined by a head 52*c*. The lower end of each leg, e.g. leg 21, is provided with a pair of horizontally-aligned openings 21*a*, 21*b* for receiving the shanks 52*a*, 52*b* of pin 52. In addition, each extension 50 is provided with a plurality of vertically-spaced pairs of horizontally-aligned openings, as shown by openings 53*a*, 53*b*; 54*a*, 54*b*; and 55*a*, 55*b*, which pairs of openings may be selectively aligned with openings 21*a*, 21*b* of the leg, according to the desired height of the sawhorse.

The lower unslotted end of each extension 50 is fitted with a rubber foot 56, which may be dimpled as shown at 57, to firmly hold the toot in the end of the extension.

The manner of using the illustrated sawhorse, and particularly the manner of adjusting its height, will be apparent from the above description. Thus, if the sawhorse is to be adjusted for minimum height, as shown in FIG. 2, extension 50 for each of the four legs would be telescopingly inserted into its respective hollow leg for a maximum distance, to align the pair of openings 55*a*, 55*b* of the extension with openings 21*a*, 21*b* of the respective leg; and the two shanks 52*a*, 52*b* of pin 52 would then be inserted into the so-aligned openings. If the height of the sawhorses is increased, e.g. to its maximum height as shown in FIG. 3, pin 52 would be removed; each of the extensions 50 would be partially withdrawn from its respective leg to align the upper pair of openings 53*a*, 53*b* of the extensions with openings 21*a*, 21*b* of the respective leg, and the pin 52 would then be reinserted into the aligned openings of each extension whenever the sawhorse is to be folded into its compact condition, this may easily be done as shown in FIG. 4.

While the invention has been described with respect to one preferred embodiment, it will be appreciated that this is set forth merely for purposes of example, and that many other variations, modifications and applications of the invention may be made.

What is claimed is:

1. A sawhorse for supporting workpieces while being worked, said sawhorse including a pair of sides which are joined at their upper ends for supporting the workpiece and which diverge towards their lower ends for stable support of the sawhorse and the workpiece thereon on a horizontal supporting surface, characterized in that the lower end of each of the sides includes a vertically-adjustable extension for adjusting the height of the sawhorse, wherein each of said sides includes a pair of horizontally-extending, vertically-spaced bracing bars joining a pair of legs of each side, and a vertically-extending re-enforcing bar joining the two bracing bars at their mid-portions;

wherein said pair of sides are pivotally mounted together at their top to an open, operative position, or to a folded, compact position for shipping or storing purposes; wherein the lower end of each of said legs is hollow, and each said extension is telescopingly received within one of said hollow legs and is fixable thereto at a selected position therein; wherein each of said extension is formed with a longitudinal slot extending from the upper end of the extension but terminating short of its lower end, the slot permitting the upper end of the extension to be forcibly deformed towards closing the slot to facilitate the insertion of the extension into the lower end of the hollow leg and the firm gripping of the extension within the hollow leg; wherein each of said legs including a pair of horizontally aligned openings; each of said extensions includes a plurality of vertically-spaced pairs of horizontally aligned openings with each horizontally aligned openings of each extension straddling said slot; and a pin of a U-shaped configuration including a head joining two parallel shanks receivable within said pair of horizontally aligned openings in each leg and a selected pair of horizontally aligned openings in the extension.

2. The sawhorse according to claim 1, wherein the lower non-slotted end of each of said extensions is fitted with a rubber foot.

3. The sawhorse according to claim 1, wherein each of said sides of the sawhorse is made as a one-piece plastic unit.

4. The sawhorse according to claim 1, wherein each of said sides further includes a one-half section of a table pivotally mounted at its opposite edges to the two sawhorse sides, the two table sections being hinged together at their confronting edges such that in the open operative position of the sawhorse, the two table sections become aligned and serve as an article holder and also as a brace for the sawhorse while the hinged edges of the table sections permit the sawhorse to be pivoted its folded compact position.

5. The sawhorse according to claim 1, wherein one or both sides of the sawhorse include outwardly-opening hooks for receiving a cable to be coiled thereon.

6. The sawhorse according to claim 1, wherein the upper end of the sawhorse includes a plurality of upwardly-opening V-shaped members for removably holding cylindrical workpieces during the working thereof.

* * * * *